US005377409A

United States Patent [19]

Chen

[11] Patent Number: 5,377,409

[45] Date of Patent: Jan. 3, 1995

[54] ONE-PUSH CLEANING MECHANISM FOR FLEXIBLE WET-SHAVING RAZOR UNIT

[75] Inventor: Evan N. Chen, Fairfield, Conn.

[73] Assignee: Warner-Lambert Company, Morris Plains, N.J.

[21] Appl. No.: 958,407

[22] Filed: Oct. 8, 1992

[51] Int. Cl.[6] ..... B26B 21/22

[52] U.S. Cl. ..... 30/41; 30/50

[58] Field of Search ..... 30/41, 49, 50

[56] References Cited

U.S. PATENT DOCUMENTS

| | | | |
|---|---|---|---|
| 3,972,114 | 8/1976 | Chao et al. | 30/50 |
| 4,047,296 | 9/1977 | Ishida et al. . | |
| 4,205,437 | 6/1980 | Chen et al. | 30/41 |
| 4,226,019 | 10/1980 | Sugiyama | 30/41 |
| 4,257,160 | 3/1981 | Murai | 30/41 |
| 4,344,227 | 8/1982 | Chen et al. | 30/41 |
| 4,395,822 | 8/1983 | Ciaffone | 30/41 |
| 4,443,939 | 4/1984 | Motta et al. | 30/49 |
| 4,854,043 | 8/1989 | Chen . | |
| 5,003,694 | 4/1991 | Chen | 30/49 |

*Primary Examiner*—Richard K. Seidel
*Assistant Examiner*—Hwei-Siu Payer
*Attorney, Agent, or Firm*—Charles W. Almer, III

[57] ABSTRACT

A cleaning mechanism for a flexible, twin-blade, wet-shaving unit designed to remove the debris that becomes lodged between the blades during shaving. The cleaning mechanism may be employed with a flexible razor units having a "slim" configuration and a centrally-fixed securing post extending through the unit. The cleaning mechanism includes an ejector bar operable between an advanced position and a retracted position and a pair of actuation return members for biasing the ejector bar to the retracted position.

33 Claims, 7 Drawing Sheets

ONE-PUSH CLEANING MECHANISM FOR FLEXIBLE WET-SHAVING RAZOR UNIT

BACKGROUND OF THE INVENTION

The present invention relates to a cleaning mechanism for a wet-shaving razor unit and, more particularly, to a one-push cleaning mechanism for a flexible, twin-blade, wet-shaving razor unit.

The use of twin-blade, wet-shaving razor units, such as disposable razors and cartridges, has become quite common. The blades in these razor units are fixedly spaced apart from one another to create a desired blade geometry. During shaving, various forms of debris, e.g., cut whiskers, shaving cream, soap, etc., can become lodged within the space between the blades. Because such shaving debris may detract from the effectiveness of the shave, various mechanisms have been suggested for removing the debris from this space during and/or after shaving.

For example, U.S. Pat. Nos. 3,972,114, 4,047,296, 4,226,019, 4,205,437, and 4,344,227 disclose various cleaning mechanisms for removing the debris that becomes lodged between the blades of a twin-blade razor unit during shaving. However, these cleaning mechanisms were designed for use with rigid, twin-blade, wet-shaving razor units and, accordingly, are not suitable for use with the recently-introduced, flexible, twin-blade, wet-shaving razor units.

In particular, the rigid, twin-blade, wet-shaving units of the prior art are typically designed with four securing posts that pass through the blades and connect the cap portion to the seat portion. Because these razor units are of a rigid design, the use of four securing posts is sufficient to maintain the components of the razor unit in the desired blade geometry during shaving. At the same time, the use of only four securing posts leaves the central portion of the razor unit free to accept a cleaning mechanism. For example, the razor unit disclosed in U.S. Pat. Nos. 4,205,437 and 4,344,227 are both rigid razor units that employ four securing posts to interconnect the components and maintain the desired blade geometry.

Recently, however, a flexible razor unit has been introduced into the commercial market. This flexible razor unit represents a significant advance in the shaving field in that the razor unit is able to flex in response to forces encountered during shaving, thereby enabling the razor unit to conform to the natural contour of the surface being shaved, which, in turn, brings a greater portion of the blades into effective, cutting contact with the surface being shaved. However, in this recently-introduced flexible razor unit, it is necessary to employ a centrally-fixed securing post to ensure that the razor unit maintains its blade geometry as the unit is flexed.

An early design of a flexible razor unit (as described in U.S. Pat. No. 4,854,043) employed three securing posts, including one centrally-fixed securing post. It was discovered, however, that the use of only three posts was insufficient to ensure that the desired blade geometry was maintained during flexing of the razor unit while shaving. An improved configuration employing five securing posts, including one centrally-fixed securing post, was subsequently designed.

This improved configuration, which employed a rectangular spacer to space the blades apart from one another, was designed and manufactured with a relatively small height and weight, a characteristic possessing desirable commercial attraction. In other words, the commercial market has come to associate a "slim" cartridge with one that provides a desirable shave, With respect to cleaning mechanisms, the need to maintain this "slim" configuration presents substantial difficulties in designing a suitable cleaning mechanism capable of being used in the existing, flexible wet-shaving razor unit.

As mentioned, the centrally-fixed securing post is an important component of the flexible razor unit. The inclusion of such a post, however, presents a substantial challenge to the design of a suitable cleaning mechanism. In particular, the ejector bar of the cleaning mechanism must be capable of forward/rearward movement in the presence of the centrally-fixed securing post. This means that both the actuator and the biasing return members must be operable with respect to this fixed post. Additionally, the cleaning mechanism must be designed to maintain the "slim" configuration of the razor unit.

Of the prior art references mentioned above, neither the cleaning mechanism disclosed in U.S. Pat. No. 4,344,227 nor the cleaning mechanism disclosed in U.S. Pat. No. 4,205,437 are employable with a razor unit having a centrally-fixed securing post. The other cited references disclose various cleaning mechanisms providing less desirable designs.

For example, U.S. Pat. No. 3,972,114 discloses a cleaning mechanism having a "saw-like" configuration and which is positioned between the blades of a twin blade razor unit. During and/or after shaving, the cleaning mechanism is operated by moving it from side to side, i.e., in a direction parallel to the blade edge. This operation requires two hands—one to hold the razor unit and the other to operate the cleaning mechanism. It is stated in the patent that this action will dislodge the debris trapped between the blades during shaving.

Next, U.S. Pat. Nos. 4,226,019 and 4,047,296 both disclose rectangular-shaped cleaning mechanisms that surround a smaller rectangular-shaped spacer. Such a design is disadvantageous when employed with flexible razor units because the rectangular spacer (having securing pins passing therethrough) significantly reduces, if not eliminates, the flexibility of such unit. As is well-known in the art, the linear distance between the ends of a flexible razor unit decreases as the unit is flexed. The design of the spacers in the above-mentioned references would limit or, not allow, the individual components of the razor units to move transversely with respect to one another as the units are flexed. Additionally, the design provides a less desirable means of biasing the ejector bar to the retracted position.

It would therefore be desirable to provide a cleaning mechanism for use in a "slim" flexible, twin-blade, wet-shaving razor unit having a centrally-fixed securing post. This cleaning mechanism must also be of such a design that it does not unduly reduce the flexibility of the device.

SUMMARY OF THE INVENTION

The present invention addresses this need in the art by providing a one-push cleaning mechanism for removing shaving debris from a twin-blade, flexible, wet-shaving razor unit. The razor unit includes cap and seat blades, each blade having a cutting edge for shaving. The razor unit also includes a centrally-fixed securing post extending therethrough. The cleaning mechanism includes an ejector bar co-extensive with the blades and operable between a biased position wherein the ejector bar is advanced forward of the cutting edge of the cap blade and a non-biased position wherein the ejector bar is retracted rearward of the cutting edge of the cap blade. The cleaning mechanism further includes an actuator fixed to the ejector bar for actuation by a user to advance the bar to eject the shaving debris. The cleaning mechanism also includes a stabilized assembly section securable to the razor unit and configured to accommodate transverse movement of the blades during flexing. The ejector bar, the actuator and the stabilized assembly section are all configured to accommodate movement of the ejector bar in the presence of the centrally-fixed securing post.

In a preferred embodiment of the present invention, the cleaning mechanism includes an actuator integrally formed with the ejector bar for moving the ejector bar to the biased position. Preferably, the actuator includes a centrally-positioned slot extending in a direction substantially perpendicular to the cutting edges of the blades for receiving the centrally-fixed securing post.

In an additional preferred embodiment, the blades are spaced apart from one another by the stabilized assembly section. Preferably, this stabilized assembly section includes a pair of opposing body segments.

In another preferred embodiment, the cleaning mechanism includes means, which biasedly connect the ejector bar and the stabilized assembly section, for returning the ejector bar to the non-biased position after removal of the shaving debris. The means for returning preferably include a pair of actuation return members. One end of one of the actuation return members is connected to one of the body segments and the other end of the actuation return member is connected to the ejector bar. The one end of the actuation return member is connected to a rear edge of one of the body segments and, preferably, forms an acute angle with an axis parallel to the cutting edge of the blades. Preferably, the other end of the actuation return member is connected to the ejector bar at a position proximate the position where the actuator connects to the ejector bar. In a preferred embodiment, this other end of the actuation return member is substantially perpendicular to the ejector bar proximate the position where the actuator connects to the ejector bar.

In a preferred embodiment, the stabilized assembly section includes a plurality of openings extending therethrough. Preferably, the openings formed in the stabilized assembly section constitute at least half of a circular opening.

In an additional preferred embodiment, the cleaning mechanism is formed such that the thickness of the ejector bar near its outer ends is reduced. Preferably, the ejector bar tapers from a first thickness to a second thickness near its outer ends. Finally, the cleaning mechanism may be integrally formed as a single unit.

In another preferred embodiment, the actuator and the ejector bar are configured to minimize the amount of continuous thermoplastic body in the region of maximum flexing.

The present invention also provides a twin-blade, flexible, wet-shaving razor unit having cap and seat blades, each of the blades having a cutting-edge for shaving. This wet-shaving razor unit has a centrally fixed securing post extending therethrough and includes a flexible cap portion and a flexible seat portion. The blades are secured between the cap and seat portions. The wet-shaving razor unit also includes a cleaning mechanism disposed between the cap and seat blades. The cleaning mechanism includes at least one ejector bar which is selectively movable from a retracted position rearward of the cutting edge of the cap blade to an advanced position forward of the cutting edge of the cap blade.

Accordingly, the present invention provides a cleaning mechanism for use in a flexible, twin-blade, wet-shaving razor unit that does not unduly reduce the flexibility of the device. The cleaning mechanism is employable with a wet-shaving razor unit having a "slim" design. This same cleaning mechanism is also employable with a flexible, wet-shaving razor unit having a centrally-fixed securing post.

DETAILED DESCRIPTION OF THE INVENTION

Figure 1:
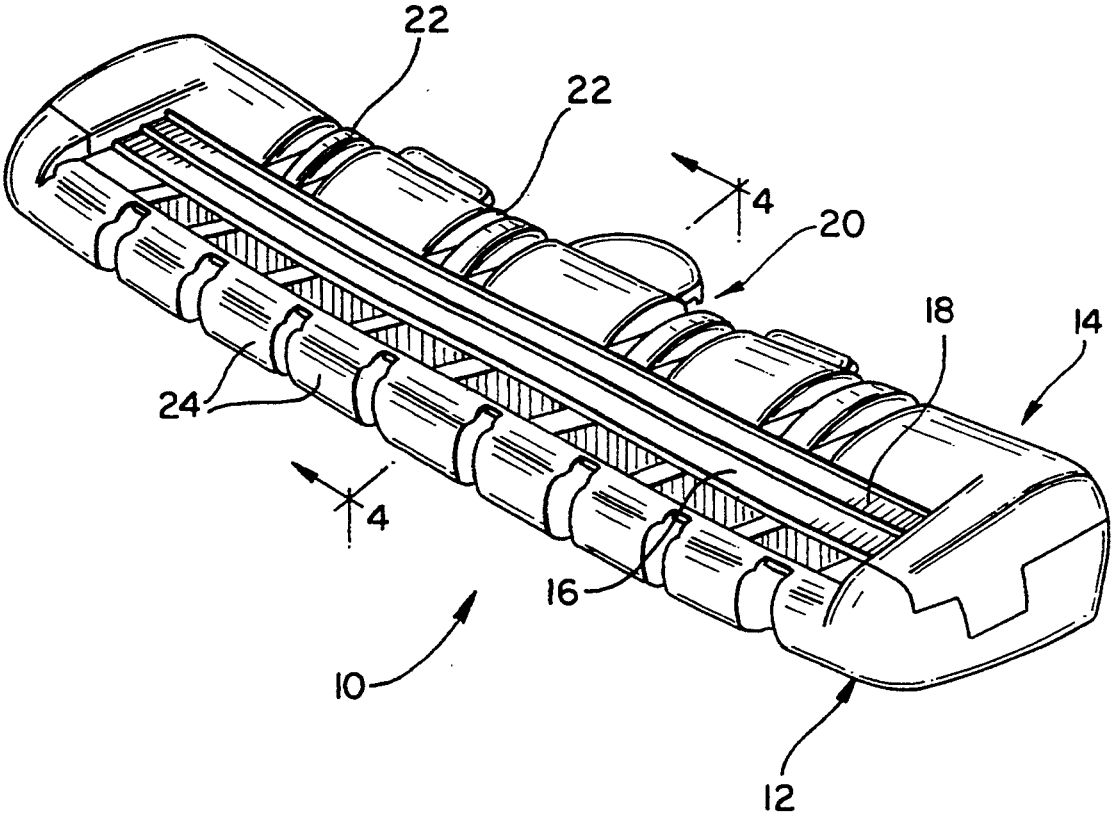
FIG. 1 is a perspective view of a flexible razor unit according to the present invention in a slightly flexed configuration.

Referring to the drawings, a flexible, twin-blade, wet-shaving razor unit 10 is illustrated in FIG. 1. As is readily seen, razor unit 10 is an assembly of parts, including a seat portion 12, a cap portion 14 and a pair of blades, i.e., a seat blade 16 and a cap blade 18. A cleaning mechanism 20 is disposed between the blades and is selectively movable from a retracted position rearward of the cutting edge of the cap blade to an advanced position forward of the cutting edge of the cap blade. The movement, which may be accomplished with one easy finger motion, results in the removal of the debris that typically becomes lodged between the blades during shaving.

Cap portion 14 includes a plurality of recesses 22 formed substantially perpendicular to the edge of the blades. These recesses are formed into the cap portion to increase the razor unit's flexibility.

Seat portion 12 includes a plurality of guard bar segments 24. The guard bar segments form a part of the unit's overall "blade geometry" and are designed as individual, interconnected elements to increase the razor unit's flexibility.

Figure 2:
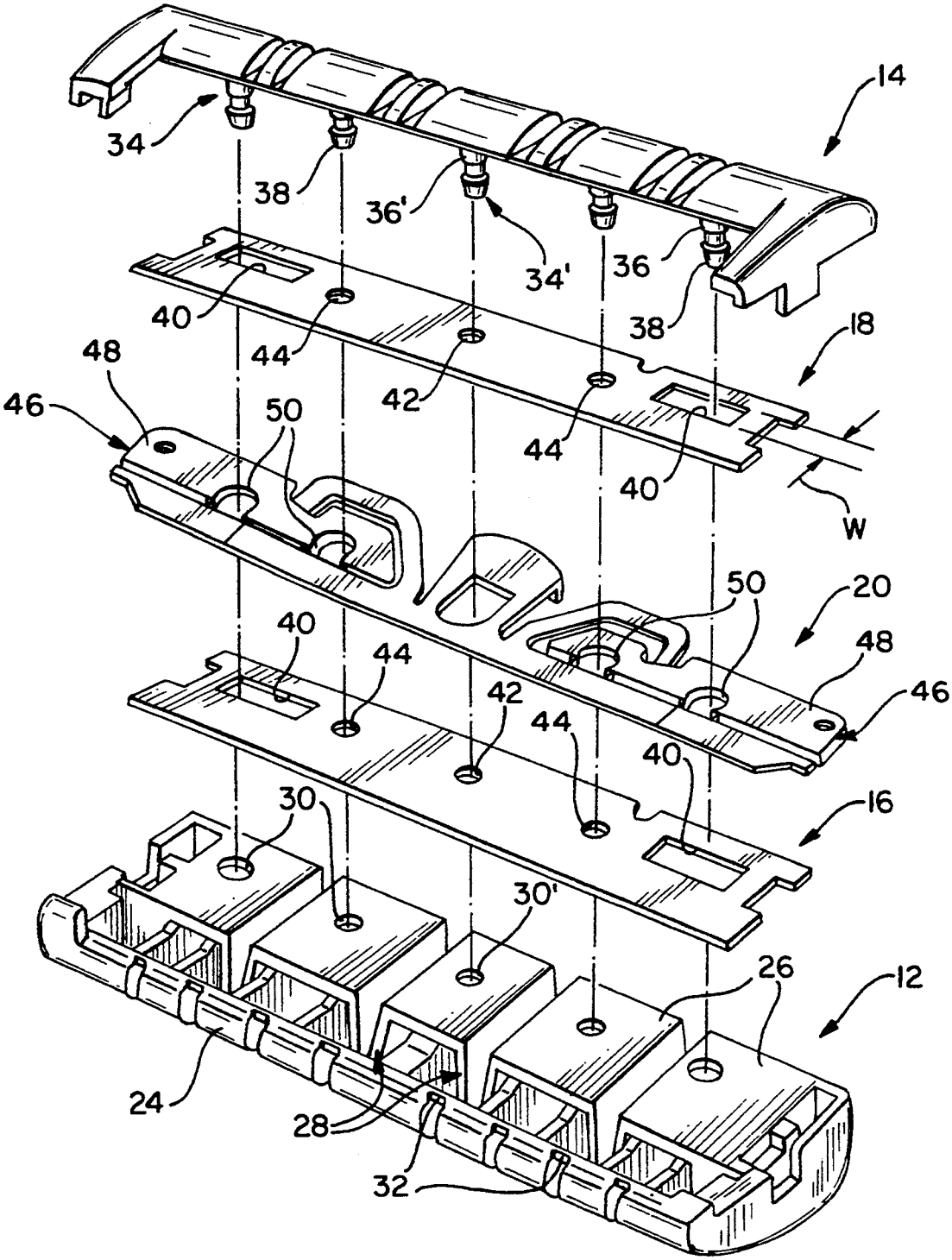
FIG. 2 is an exploded, perspective view of the flexible razor unit of FIG. 1.

Referring to FIG. 2, a preferred embodiment of the present invention is illustrated in an exploded format. As is readily seen, cleaning mechanism 20 is sandwiched between seat blade 16 and cap blade 18. In turn, this subassembly (i.e., seat blade 16, cleaning mechanism 20 and cap blade 18) is sandwiched between seat portion 12 and cap portion 14.

Seat portion 12 includes blade platforms 26, which are interconnected by living hinges 28. Living hinges 28 allow each individual blade platform to flex independently of the others. Moreover, each of the blade platforms includes a chamfered receiving hole 30. Guard bar elements 24 are secured to these blade platforms. Additionally, the guard bar elements may be interconnected by means of a guard bar rail 32.

Cap portion 14 is formed with a plurality of downwardly extending securing posts 34, including a centrally-fixed securing post 34'. Posts 34 include shafts 36 and bulbous ends 38. Posts 34 are configured to pass through a set of corresponding holes in the cap blade, cleaning mechanism and seat blade, before being received by holes 30 in blade platforms 26. Once bulbous ends 38 have passed through holes 30, cap portion 14 becomes locked to seat portion 12, which, in turn, secures the blades and cleaning mechanism therebetween.

It is known to those skilled in the art that the linear distance between the ends of a flexible razor unit decreases as the unit is flexed. In this regard, the individual components of such razor unit must be capable of transverse movement with respect to one another. For example, living hinges 28, which connect blade platforms 26, provide sufficient "transverse play" to allow the seat portion of the razor unit to flex in cooperation with the cap portion.

With respect to the blades sandwiched between the seat and cap portions, each of the blades is formed with a pair of opposing rectangular openings 40. These rectangular openings, which are necessary for fabrication purposes, also allow for transverse movement of the blades as the razor unit is flexed. Additionally, the rectangular openings are formed with a width W substantially equal to the diameter of securing posts 34. This ensures that the cutting edges of the blades remain parallel to one another during shaving.

Each of the blades is also formed with a center circular hole 42 sized to snugly accept shaft 36' of securing posts 34' and a pair of surrounding circular holes 44 sized slightly larger than the diameter of shafts 36 of securing posts 34. Again, over-sized holes 44 provide "transverse play" to allow transverse movement of the blades (with respect to the other components of the razor unit) during flexing. The components of the razor unit (at the center of such razor unit) are maintained at a constant transverse orientation by designing hole 42 in both the seat and cap blade to snugly accept the centrally-fixed securing posts.

Referring now to the cleaning mechanism, such cleaning mechanism must also be able to tolerate transverse movement of the components of the razor unit (with respect to one another) as the unit is flexed. Such a requirement presents an unusual problem in that it is not possible to simply provide the cleaning mechanism with over-sized holes, as was done with the blades. The reason for this limitation involves the need to maintain stabilized assembly section 46 in a fixed forward/rearward orientation.

In a preferred embodiment, stabilized assembly section 46 includes a pair of opposing body segments 48, which, among other things, serve to space the blades. These body segments must be able to move transversely in cooperation with the other components of the razor during flexing, yet, at the same time, must be prevented from moving in a forward/rearward direction (i.e., in a direction perpendicular to the cutting edges of the blades).

This unusual problem is addressed by the design of the present cleaning mechanism. In particular, each of body segments 48 includes a pair of openings 50 which allow securing posts 34 to pass therethrough. However, unlike the corresponding holes formed in the blades, openings 50 must be formed such that they "hug" the securing posts. This prevents the entire cleaning mechanism from shifting forward when such mechanism is operated (as opposed to simply having the ejector bar move forward). Stated differently, if the entire cleaning mechanism were to shift forward, there would be no biasing effect to withdraw the ejector bar.

Figure 3:
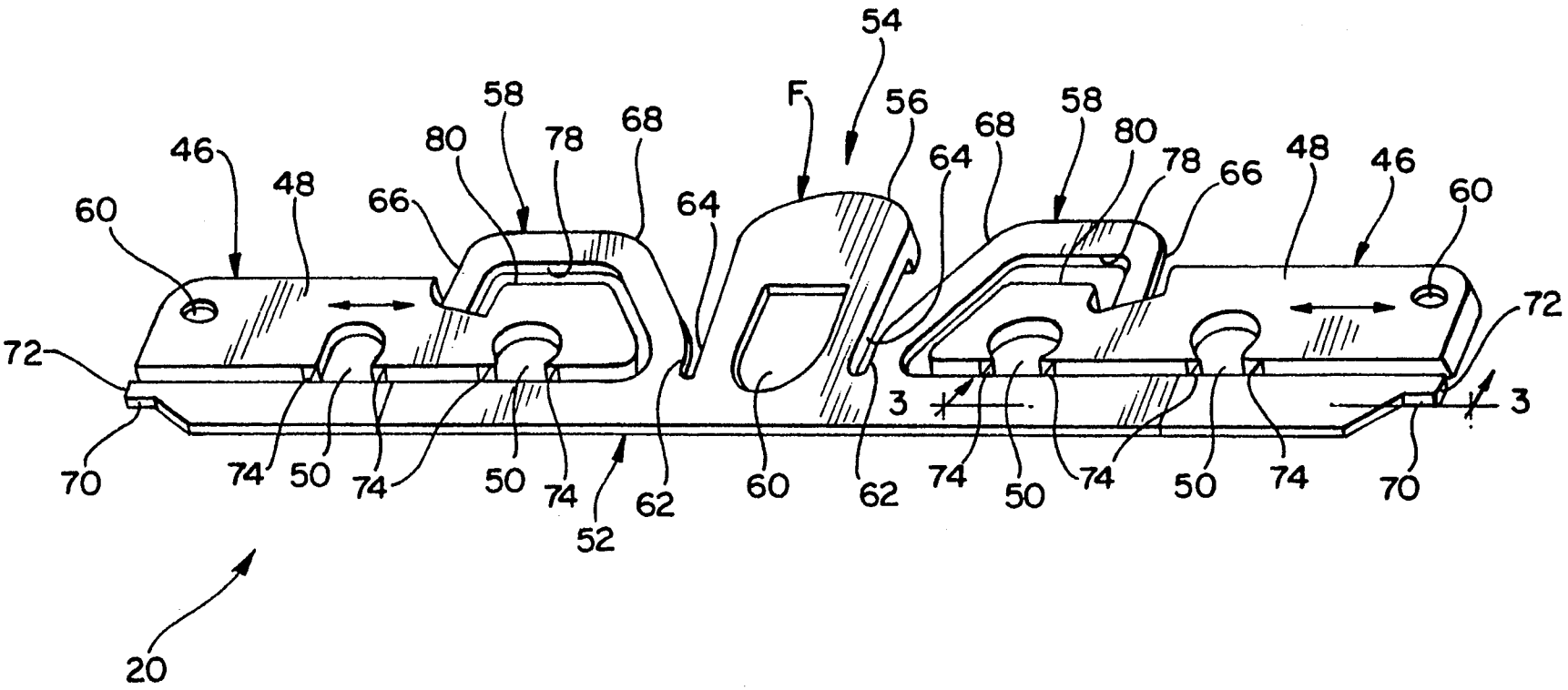
FIG. 3 is an enlarged, perspective view of the cleaning mechanism of the present invention.

In a preferred embodiment of the present invention, cleaning mechanism 20, as best shown in FIG. 3, includes an ejector bar 52 coextensive with both of the blades, an actuator 54 having an actuator button 56, and a pair of actuation return members 58 for biasing the ejector to the retracted position. Preferably, actuator 54 is positioned in the central portion of the razor unit.

With respect to transverse movement of body segments 48, such movement is allowed because of the inventive design of the cleaning mechanism. More specifically, the configuration and orientation of actuation return members 58 allow each of the body segments to move transversely in cooperation with the other components of the razor unit as such unit is flexed. (The direction of this movement is depicted by the arrows in FIG. 3.)

Because the stabilized assembly section must not be permitted to move in the forward/rearward direction (i.e., the direction perpendicular to the blade edge), each of openings 50 must constitute at least half a hole to ensure that the assembly section "hugs" the securing pin passing therethrough. The location of these openings with respect to the razor unit is fixed by the preexisting geometry of such unit. In the existing design of this preferred flexible razor unit, there was simply not enough room (provided a rectangular-shaped ejector bar was desired) to include a full circular hole in the assembly section. Accordingly, the present design allows the cleaning mechanism to be incorporated into the existing flexible razor unit, while also allowing the rectangular-shaped ejector bar to be employed.

Actuator 54 is integrally formed with ejector bar 52. A forward force F on actuator button 56 of actuator 54 operates to move ejector bar 52 forward in a direction perpendicular to and toward the exposed edges of the blades. This forward movement of ejector bar 52 dislodges the shaving debris that becomes lodged between the blades during shaving. In this respect, actuator 54 is provided with a central longitudinal slot 60 which allows forward movement of the actuator and, in turn, the ejector bar, in the presence of centrally-fixed securing post 34'.

The retraction of the ejector bar from the advanced position is accomplished by actuation return members 58. In the relaxed position, the actuation return members assume the configuration shown in FIG. 3. However, when the mechanism is operated by pushing it forward, actuation return members 58 are deformed so that they act as return springs, pulling the mechanism back to the relaxed configuration shown in FIG. 3.

As illustrated, each actuation return member includes a forward connecting portion 62, which, according to the illustrated embodiment, is positioned substantially perpendicular to the longitudinal axis of the ejector bar.

This configuration allows the return member to operate in the presence of centrally-fixed securing post 34'. Each forward connecting portion 62 is preferably connected to the ejector bar at a location in close proximity to the point where actuator 54 joins the ejector bar. By connecting the biasing members to the ejector bar at these locations, slots 64 are formed. When the razor unit is assembled, slots 64 become aligned with the living hinges adjacent to the centrally-positioned blade platform. By designing the cleaning mechanism in such a manner, there is a minimum amount of continuous body bridging this region of maximum flexing. As a result, the razor unit's resistance to flexing is decreased.

Each of the biasing members also has a rear connecting portion 66, which connects the actuation return member to the stabilized assembly section. Rearward connecting portions 66 are joined to the rear edges of body segments 48 at an angle with respect to the longitudinal axis of the ejector bar to facilitate transverse movement of these section. Forward connecting portion 62 and rearward connecting portion 66 are, in turn, connected by a dogleg-shaped member 68. This design enables the dogleg-shaped member 68 to operate as a return spring, e.g., a tension leaf spring, for returning the actuator to the configuration shown in FIG. 3 after operation.

Figure 3A:
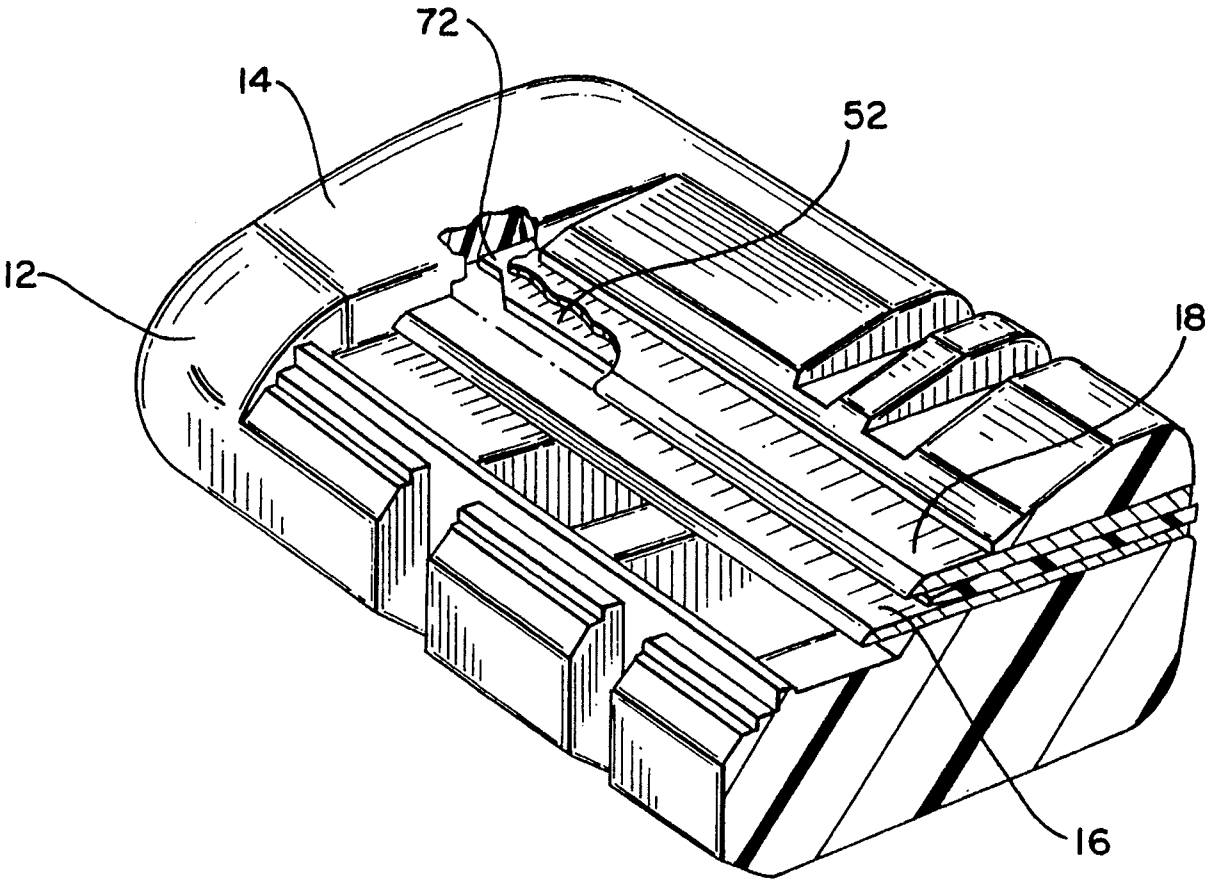
FIG. 3*a* is an enlarged detail, in partial section, of FIG. 1.

In a preferred embodiment, the side edges of ejector bar 52 are notched to create guide tabs 70. Referring to FIG. 3*a*, guide tabs 70 extend past the exposed portion of the blades and into the side regions of the razor unit. Because the guide tabs are, at all times, maintained within these side regions, they serve to guide the ejector bar back to its retracted position after operation of the cleaning mechanism.

Figure 3B:
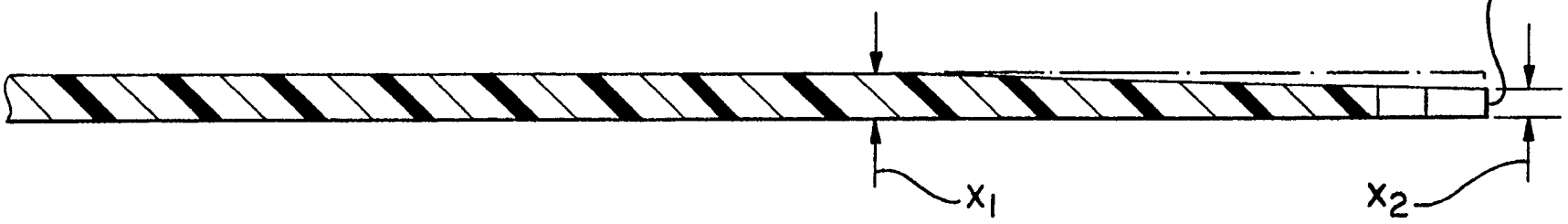
FIG. 3*b* is a cross-sectional view of the ejector bar taken along line 3*a*—3*a* of FIG. 3.

Referring now to FIG. 3*b*, the thickness at outer ends 72 of ejector bar 52 is less than the thickness of the ejector bar at its center. In other words, the outer ends of the ejector bar are tapered from a thickness $X_1$ to a reduced thickness $X_2$. It is necessary to design ejector bar 52 in this manner to ensure proper operation of the ejector bar. More particularly, the distance between the outer ends of the ejector bar and the central portion of the bar, that is, where it contacts actuator 54, is, in relative terms, a large distance. If the ejector bar is formed with a constant thickness, it might tend to "stick" at these outer locations, thereby causing the cleaning mechanism to rotate about such point when operated. By reducing the thickness of the ejector bar at these outer locations, the force required to move the ejector bar (in particular, at its outer ends), is significantly reduced.

The different segments of cleaning mechanism 20 have been described separately for purposes of clarity. However, according to a preferred embodiment of the present invention, the entire cleaning mechanism is formed in a single manufacturing step, for example, by molding. More particularly, a number of break-away tabs 74 are integrally formed with the ejector bar and spacers in order to stabilize these elements during assembly of the razor unit. The break-away tabs 74 are formed in such a manner that upon completion of the razor unit assembly, a forwardly-directed force (e.g., force F) applied to actuator button 56 easily breaks the tabs, thereby separating the spacers from the ejector bar.

Figure 4:
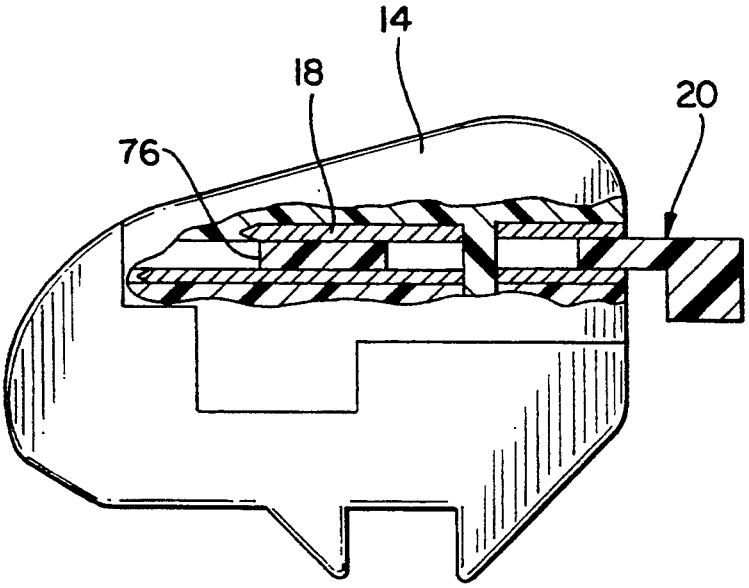
FIG. 4 is a cross-sectional view of the flexible razor unit taken along line 4—4 of FIG. 1 illustrating the cleaning mechanism in its retracted position.
Figure 5:
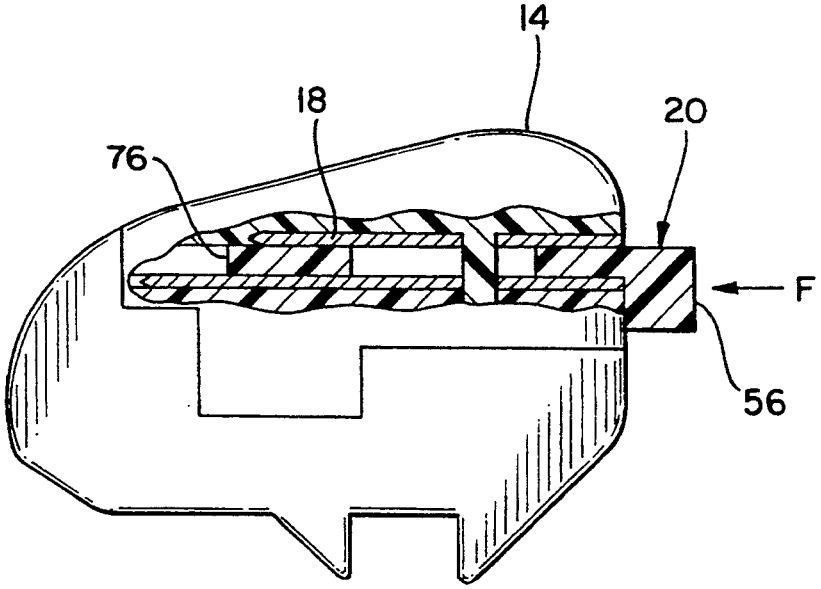
FIG. 5 is the same cross-sectional view as FIG. 4 with the cleaning mechanism in an advanced position.

Referring to FIG. 4, the razor unit is shown with cleaning mechanism 20 in its normally retracted position. In this position, leading edge 76 of the ejector bar is located rearward of the cutting edge of cap blade 18. When force F is applied to actuator button 56, as shown in FIG. 5, the ejector bar is displaced forward until leading edge 76 is forward of the cutting edge of cap blade 18. (The direction forward refers to the direction indicated by arrow F in FIG. 5.) The displacement forward of the ejector bar is limited by actuator button 56 contacting the rear surface of cap portion 14, as shown in FIG. 5. The displacement is also limited by inner edges 78 (see FIG. 3) of actuation return members 58 contacting rear edges 80 of body segments 48. When the actuating force is released from the actuating button, actuation return members 58 return the ejector bar to its normally retracted position rearward of the exposed edge of the cap blade.

In order to facilitate smooth movement of the actuator, actuation return members and ejector bar, it is necessary to form these portions with a reduced thickness. In the present design, the stabilized assembly section is formed with an increased thickness to allow the reduced thickness portions to move freely. Preferably, the section has a thickness of approximately 0.020 inches. To allow free movement of the movable portions, those portions may be provided with a thickness of, for example, 0.017 inches.

Figure 6:
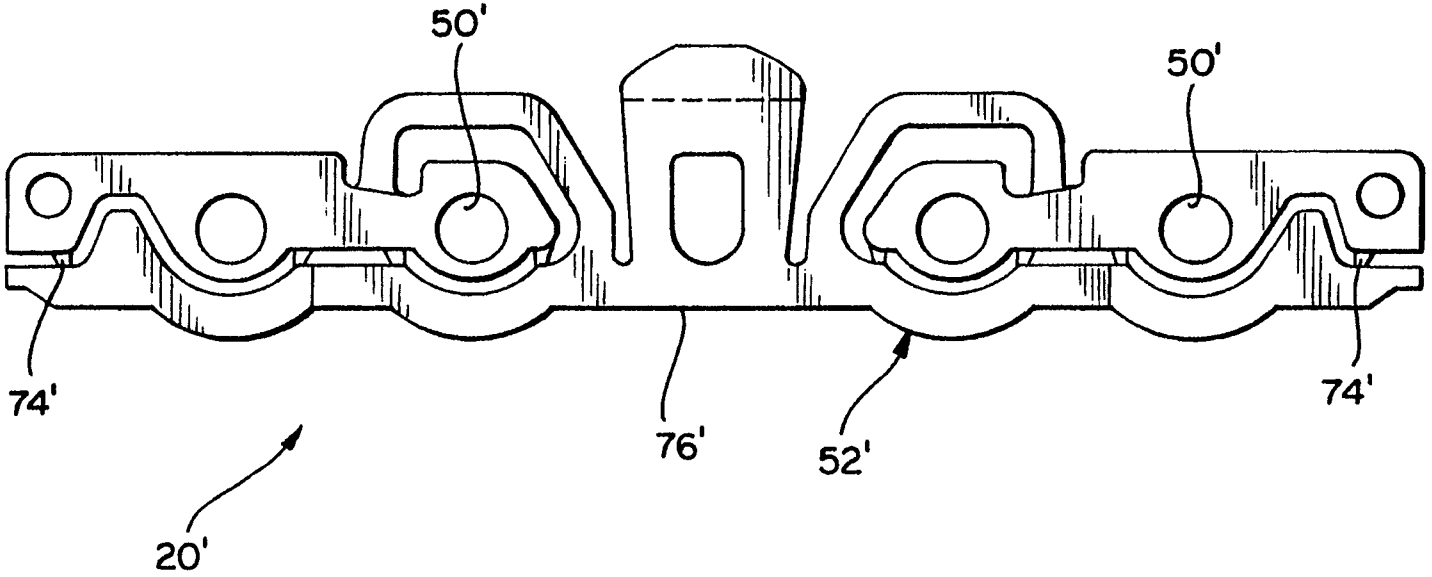
FIG. 6 is a top plan view of an alternative embodiment of the cleaning mechanism of the present invention.

An alternative embodiment of cleaning mechanism, i.e., cleaning mechanism 20' is shown in FIG. 6 According to this alternative embodiment, cleaning mechanism 20' is formed such that holes 50' are completely surrounded by plastic material. Because this design increases the width of the spacers, ejector bar 52' of this embodiment is formed with a non-linear configuration. As illustrated, ejector bar 52' is provided with a curved leading edge 76' in order to compensate for the increased width of the spacers.

According to another embodiment of the present invention, a shaving aid is incorporated into the razor head of the present invention. It will be appreciated by those skilled in the art that the shaving aid can be incorporated by several different methods, including attaching or embedding the shaving aid to a portion of the razor unit, for example, cap portion 14.

Exemplary materials constituting the shaving aid may include one or more various combinations of the following:

A. A lubricating agent for reducing the frictional forces between the razor unit and the skin, e.g., a microencapsulated silicone oil, polyurethane-polyvinylpyrrolidone interpolymer, etc.

B. An agent which reduces the drag between the razor parts and the shaver's face, e.g., a polyethylene oxide in the range of molecular weights between 100,000 and 6,000,000; a non-ionic polyacrylamide; and/or a natural polysaccharide derived from plant materials such as "guar gum."

C. An agent which modifies the chemical structure of the hair to allow the razor blade to pass easily through the whiskers, e.g., a depilatory agent.

D. A cleaning agent which allows the whisker and skin debris to be washed more easily from the razor parts during shaving, e.g., a silicone polyethylene oxide block copolymer and detergent such as sodium lauryl sulphate.

E. A medicinal plant for killing bacteria, or repairing skin damage and abrasions.

F. A cosmetic agent for softening, smoothing, conditioning or improving the skin.

G. A blood coagulant for the suppression of bleeding that occurs from nicks and cuts.

H. An astringent for constricting blood vessels, thereby stemming the flow of bodily fluids such as lymph, which may exude from skin that has been irritated during shaving.

While there have been described what are presently believed to be the preferred embodiments of the invention, those skilled in the art will realize that various changes and modifications may be made to the invention without departing from the spirit of the invention, and it is intended to claim all such changes and modifications as fall within the scope of the invention.

What is claimed is:

1. A twin-blade, flexible, wet-shaving razor unit in combination with a one-push cleaning mechanism for removing shaving debris, said razor unit formed with a plurality of blade platforms interconnected by a plurality of living hinges, said razor unit including a centrally-positioned blade platform and, a cap and seat blades, each of said blades having a cutting edge for shaving, and a centrally-fixed securing post extending through said cleaning mechanism, said cleaning mechanism comprising:

an ejector bar coextensive with said blades and operable between a biased position wherein said ejector bar is advanced forward of said cutting edge of said cap blade and a non-biased position wherein said ejector bar is retracted rearward of said cutting edge of said cap blade and wherein only a portion of said ejector bar traverses the living hinges adjacent said centrally-positioned blade platform;

an actuator fixed to said ejector bar for actuation by a user to advance said bar to eject said debris;

a stabilized assembly section securable to said razor unit and configured to accommodate transverse movement of said blades during flexing;

securing posts for securing said stabilized assembly section to said razor unit;

wherein said actuator is integrally formed with said ejector bar and said actuator includes a centrally-positioned slot extending in a direction substantially perpendicular to the cutting edges of said blades for receiving said centrally-fixed securing post;

openings located to accommodate said securing posts for securing said stabilized assembly section to said razor unit, said actuator and said ejector bar; and wherein said actuator and said ejector bar are comprised of a continuous thermoplastic body and said openings are configured such that a minimal amount of thermoplastic material is located in the region of maximum flexing, adjacent to the centrally-fixed securing post.

2. The combination according to claim 1, further comprising means, biasedly connecting said ejector bar and said stabilized assembly section, for returning said ejector bar to said non-biased position after ejection or said shaving debris.

3. The combination according to claim 2, wherein said means for returning includes a pair of actuation return members.

4. The combination according to claim 3, wherein the body of each of said pair of actuation return members has a dogleg shape for reducing the stress introduced into said member during actuation.

5. A twin-blade, flexible, wet-shaving razor unit in combination with a one-push cleaning mechanism for removing shaving debris, said razor unit having a cap and seat blades, each of said blades having a cutting edge for shaving, and a centrally-fixed securing post extending therethrough said cleaning mechanism, said combination comprising:

an ejector bar coextensive with said blades and operable between a biased position wherein said ejector bar is advanced forward of said cutting edge of said cad blade and a non-biased position wherein said ejector bar is retracted rearward of said cutting edge of said cap blade;

an actuator integrally formed with said ejector bar for actuation by a user, said actuator including a centrally-positioned slot extending in a direction substantially perpendicular to the cutting edge of said blades for receiving said centrally-fixed securing post;

a stabilized assembly section securable to said razor unit and configured to accommodate transverse movement of said blades during flexing;

means for securing said assembly section to said razor unit; and wherein said ejector bar, said actuator and said stabilized assembly section are situated in a manner to allow movement of said ejector bar in the presence of said centrally-fixed securing post.

6. The combination according to claim 5, wherein said blades are spaced apart from one another by said stabilized assembly section.

7. The combination according to claim 6, wherein said stabilized assembly section comprises a pair of opposing body segments.

8. The combination according to claim 5, further comprising means, biasedly connecting said ejector bar and said stabilized assembly section, for returning said ejector bar to said non-biased position after ejection of said shaving debris, wherein said stabilized assembly section comprises a pair of opposing body segments, said means for returning including a pair of actuation return members, and wherein one end of one of said actuation return members is connected to one of said body segments and wherein the other end of said actuation return member is connected to said ejector bar at a position proximate the position where said actuator connects to said ejector bar and the other actuation return member is similarly connected to the other one of said body segments and said ejector bar.

9. The combination according to claim 8, wherein the bodies of said actuation return members have dogleg shapes for reducing the stress introduced into said members during actuation.

10. The combination according to claim 8, wherein the other end of said one of said actuation return members is substantially perpendicular to said ejector bar proximate the position where said actuator connects to said ejector bar.

11. The combination according to claim 8, wherein said one end of said one of said actuation return members is connected to a rear edge of one of said body segments.

12. The combination according to claim 4, wherein said one end of said one of said actuation return members forms an acute angle with an axis parallel to said cutting edges of said blades.

13. The combination according to claim 5, wherein said stabilized assembly section includes a plurality of openings extending therethrough.

14. The combination according to claim 13, wherein each of said openings formed in said stabilized assembly section constitutes at least half of a circular hole.

15. The combination according to claim 5, wherein the outer ends of said ejector bar are notched to form guide tabs.

16. The combination according to claim 15, wherein said guide tabs extend past the exposed portion of said cutting edges of said blades.

17. The combination according to claim 16, wherein said guide tabs serve to guide said ejector bar to said retracted position after ejection of said shaving debris.

18. The combination according to claim 5, wherein the thickness of said ejector bar near its outer ends is reduced to facilitate forward movement of said ejector bar.

19. The combination according to claim 18, wherein the ejector bar tapers from a first thickness to a second thickness near its outer ends.

20. The combination according to claim 5, wherein said combination is integrally formed as a single unit.

21. The combination according to claim 5, wherein said ejector bar has a non-linear leading edge.

22. A twin-blade, flexible wet-shaving razor unit having cap and seat blades, each of said blades having a cutting edge for shaving, said unit having a centrally-fixed securing post extending therethrough comprising:

a flexible cap portion and a flexible seat portion, said blades secured between said cap and seat portions; and a cleaning mechanism disposed between said cap and seat blades, said cleaning mechanism including an ejector bar coextensive with said blades and operable between a biased position wherein said ejector bar is advanced forward of said cutting edge of said cap blade and a non-biased position wherein said ejector bar is retracted rearward of said cutting edge of said cap blade;

an actuator integrally formed with said ejector bar for actuation by a user to advance said bar to eject said debris, said actuator including a centrally-positioned slot extending in a direction substantially perpendicular to the cutting edges of said blades for receiving said centrally-fixed securing post;

a stabilized assembly section securable to said razor unit and configured to accommodate transverse movement of said blades during flexing;

means, biasedly connecting said ejector bar and said stabilized assembly section, for returning said ejector bar to said non-biased position after ejection of said shaving debris; and wherein said actuator and said means for returning are configured to accommodate movement of said elector bar in said razor unit.

23. The razor unit according to claim 22, wherein said blades are spaced apart from one another by said stabilized assembly section.

24. The razor unit according to claim 23, wherein said stabilized assembly section comprises a pair of opposing body segments.

25. The razor unit according to claim 24, wherein said means for returning includes a pair of actuation return members.

26. The razor unit according to claim 25, wherein the body of each of said pair of said actuation return members has a dogleg shape for reducing the stress introduced into said member during actuation.

27. The razor unit according to claim 25, wherein one end of one of said actuation return members is connected to one of said body segments and wherein the other end of said one of said actuation return members is connected to said ejector bar.

28. The razor unit according to claim 27, wherein the other end of said one of said actuation return members is connected to said ejector bar at a position proximate the position where said actuator is connected to said ejector bar.

29. The razor unit according to claim 27, wherein said one end of said one of said actuation return members is connected to a rear edge of one of said body segments.

30. The razor unit according to claim 22, wherein said combination is integrally formed as a single element.

31. The razor unit according to claim 22, wherein said ejector bar has a non-linear leading edge.

32. The razor unit according to claim 22, wherein said cap portion includes a plurality of securing posts which pass through a corresponding plurality of post-receiving passages in said blades, said combination and said seat portion.

33. The razor unit according to claim 32, wherein said blades are laterally movable with respect to at least one of said posts during the flexing of said razor unit.

* * * * *